US007578774B1

(12) United States Patent
Zetterberg

(10) Patent No.: US 7,578,774 B1
(45) Date of Patent: Aug. 25, 2009

(54) RESISTANCE EXERCISE MACHINE

(76) Inventor: Robert T. Zetterberg, 61 Haymaker La., Levittown, NY (US) 11756-3436

( * ) Notice: Subject to any disclaimer, the term of this patent is extended or adjusted under 35 U.S.C. 154(b) by 0 days.

(21) Appl. No.: 11/941,632

(22) Filed: Nov. 16, 2007

(51) Int. Cl.
*A63B 21/008* (2006.01)
*A63B 1/00* (2006.01)
*A63B 21/00* (2006.01)

(52) U.S. Cl. ..... 482/112; 482/38; 482/92

(58) Field of Classification Search ..... 482/38, 482/39, 111–113, 135, 4, 5, 91–95, 104, 482/133
See application file for complete search history.

(56) References Cited

U.S. PATENT DOCUMENTS 3,359,802 A * 12/1967 Sollenberger ..... 482/112
3,397,884 A * 8/1968 Blasi ..... 482/91
3,424,005 A * 1/1969 Brown ..... 482/8
3,451,271 A * 6/1969 Knoblauch ..... 482/113
3,465,592 A * 9/1969 Perrine ..... 482/5
3,524,644 A * 8/1970 Kane ..... 482/129
3,606,318 A * 9/1971 Gilstrap ..... 482/112
3,874,658 A 4/1975 Flowers
4,050,310 A * 9/1977 Keiser ..... 482/2
4,063,726 A * 12/1977 Wilson ..... 482/5
4,249,726 A 2/1981 Faust
4,253,662 A 3/1981 Podolak
4,326,707 A * 4/1982 Strecker ..... 482/113
4,444,390 A * 4/1984 Erickson ..... 482/113
4,540,171 A 9/1985 Clark et al.
4,750,739 A * 6/1988 Lange ..... 482/104
4,765,610 A 8/1988 Sidwell
4,799,672 A * 1/1989 Barrett ..... 482/104
4,949,959 A 8/1990 Stevens
5,372,564 A * 12/1994 Spirito ..... 482/112
D366,915 S 2/1996 Clem
5,823,921 A 10/1998 Dawson

* cited by examiner

*Primary Examiner*—Loan H Thanh
*Assistant Examiner*—Allana Lewin

(57) ABSTRACT

This patent discloses a machine to assist a person in strength training. The strength training machine may have a bar supported between two uprights. A motor and mechanisms may cause the bar to move up and down at a constant rate. A person may position themselves above, below, or to a side of the bar. As the bar moves, a person may push or pull against the resistance provided by the moving bar. The motor and mechanisms may prevent the bar from moving in response to the person pressing or pulling against the bar, no matter how hard the person presses or pulls on the bar.

20 Claims, 6 Drawing Sheets

RESISTANCE EXERCISE MACHINE

BACKGROUND

1. Field

The information disclosed in this patent relates to exercise equipment that may provide strength training with endurance training.

2. Background Information

Strength training involves the use of resistance to muscular contraction to build the strength, anaerobic endurance, and size of skeletal muscles. There are several different methods of strength training, the most common being the use of gravity (weight training) to oppose muscle contraction or the use of variable elastic/hydraulic forces (resistance training) to oppose muscle contraction. Weight training uses the force of gravity (in the form of weighted bars, dumbbells or weight stacks) to oppose the force generated by muscle through concentric or eccentric contraction. Resistance training increases muscle strength by pitting the muscles against a weight or force. However, weight training and resistance training lack safe and convenient ways to perform strength training exercises.

SUMMARY

This patent discloses a machine to assist a person in strength training. The strength training machine may have a bar supported between two uprights. A motor and mechanisms may cause the bar to move up and down at a constant rate. A person may position themselves above, below, or to a side of the bar. As the bar moves, a person may push or pull against the resistance provided by the moving bar. The motor and mechanisms may prevent the bar from moving in response to the person pressing or pulling against the bar, no matter how hard the person presses or pulls on the bar.

DETAILED DESCRIPTION

Figure 1:
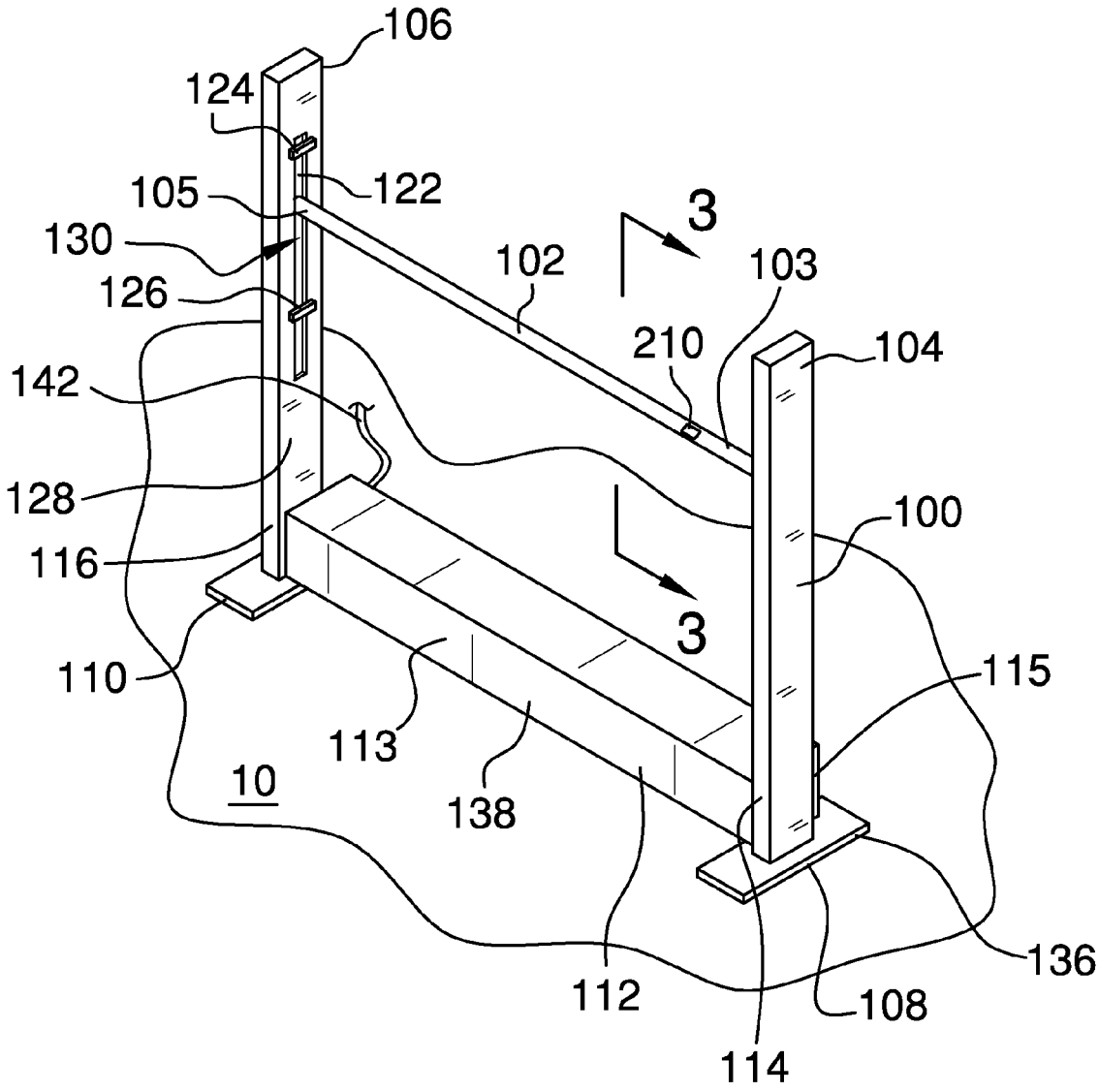
FIG. 1 is an isometric front view of a machine 100.
Figure 2:
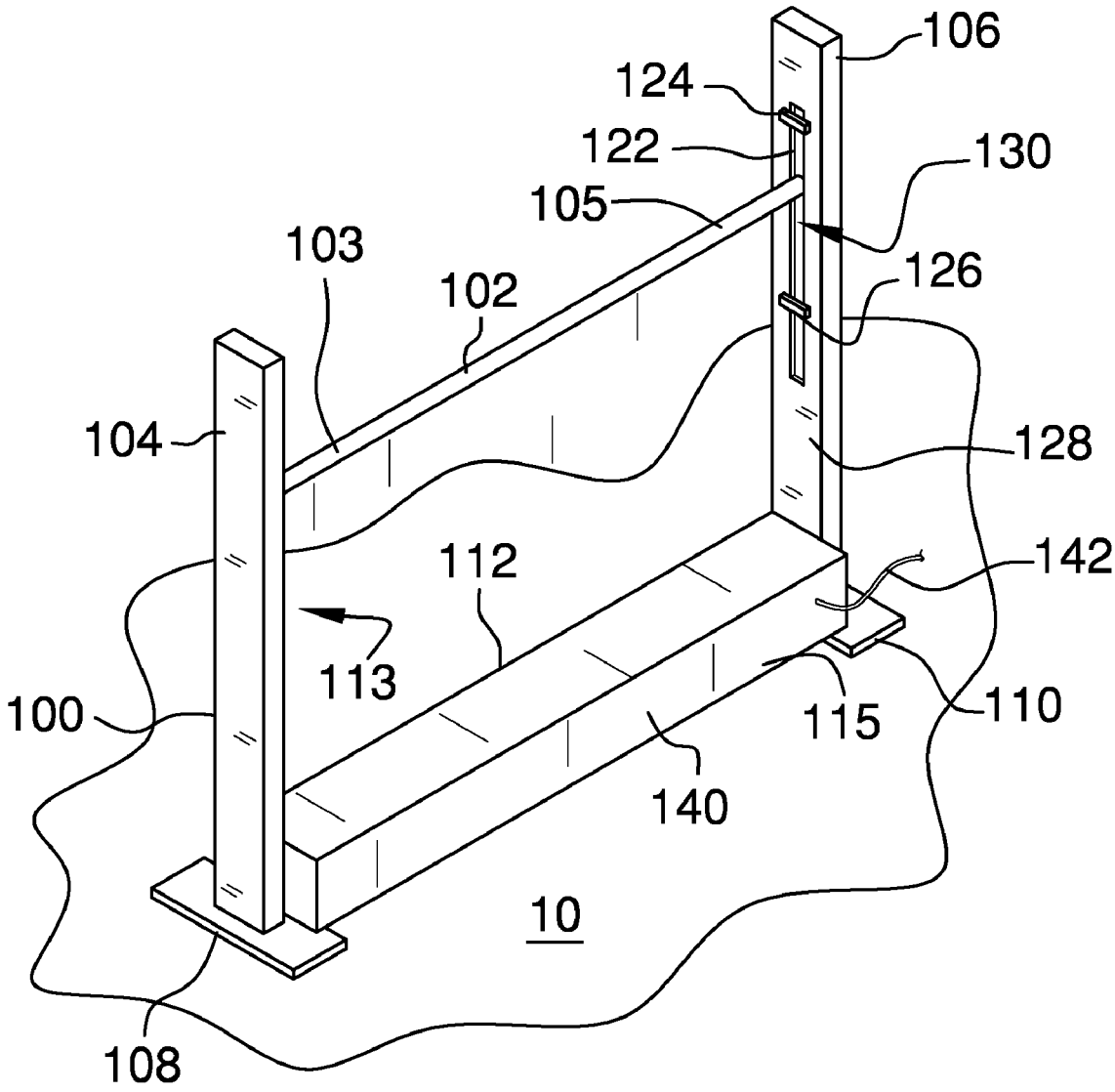
FIG. 2 is an isometric rear view of machine 100.

FIG. 1 is an isometric front view of a machine 100. FIG. 2 is an isometric rear view of machine 100. Machine 100 may be an electro-mechanical device that may assist a person in strength training, such as strength training the full body of the person through bar press, bar pull, squats, lunges, and calf raises. Machine 100 may be thought of as a strength training machine and a full body strength training machine. Machine 100 may allow a person to use full force, through a full range of arm motion, without any resistance from gravity or variable resistance from elastics/hydraulics.

In general, a motor 202 (FIG. 6) may raise and lower a bar 102 (FIG. 1) at a predetermined speed. A person positioned below bar 102, for example, may grab bar 102 and press as hard as that person can against bar 102. Since motor 202 may restrict movement of bar 102 to the predetermined speedy, the effectiveness of the exercise to the person's body may be determined by the amount of force exerted by the person, rather than a particular amount of machine weight used. In this way, the person may create a best weight for that individual at each arm position within the range of motion of bar 102, including the weakest and strongest points of a person's arm lift range.

In addition to providing a best weight for that individual at each arm position within the range of motion of bar 102, machine 100 may offer an effective cardiovascular workout. For example, the rate of speed at which motor 202 raises and lowers bar 102 may be set to require the person to move their arms more quickly when exacting force against bar 102. Moving their arms more quickly may increase that individual's heart, circulatory, and respiratory rates.

Machine 100 may include bar 102, a left upright 104, a right upright 106, a left foot 108, a right foot 110, and a motor housing 112. Machine 100 may have a machine front 113 and a machine rear 115 and a designation of left and right may be from the view of a standing person facing machine rear 115 (FIG. 2) or from a person lying on their back on a bench (12) (FIG. 5) looking up at bar 102. Bar 102 may be supported between left upright 104 and right upright 106. Left foot 108 may be positioned on a left upright lower end 114 and right foot 110 may be positioned on a right upright lower end 116. Motor housing 112 may be positioned between left upright 104 and right upright 106 below bar 102 and above left foot 108 and right foot 110.

Bar 102 may be a rigid cylinder around which human hands may grab with ease. Bar 102 may have a bar left side 103 near a first end of bar 102. In addition, bar 102 may have a bar right side 105 near a second end of bar 102 that may be on a side of bar 102 that may be opposite of bar left side 103.

Left upright 104 and right upright 106 may have similar structural elements that may cooperate to assist in moving bar 102. Left upright 104 and right upright 106 may cooperate to restrict movement of bar 102 to up and down directions only. In addition, left upright 104 and right upright 106 may cooperate to move bar 102 within a predetermined range. Further, left upright 104 and right upright 106 may assist in stabilizing machine 100 on a floor 10.

Figure 3:
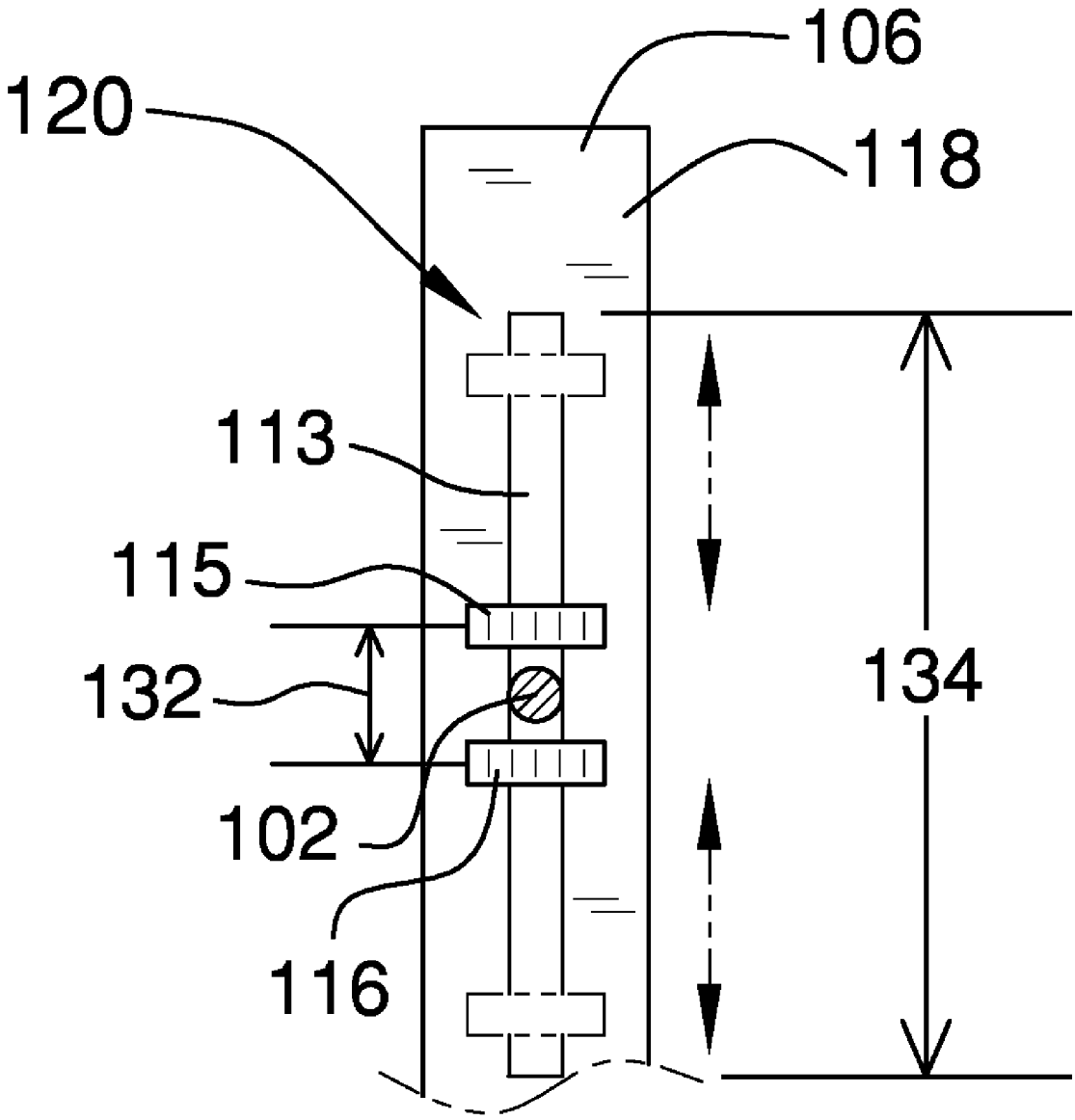
FIG. 3 is a section view of right upright 106 generally taken off line 3-3 of FIG. 1.

FIG. 3 is a section view of left upright 104 generally taken off line 3-3 of FIG. 1. Left upright 104 may have a left slot 113, a left top range set 115, and a left bottom range set 116. Left slot 113 may be a rectangular slit extending vertically along a left upright bar side 118. Left slot 113 may extend through left upright bar side 118 to provide access to a left upright interior 120. Left upright 104 largely may be hollow and enclosed completely except for left slot 113. Left upright interior 120 may be the hollow region that may be inside left upright 104. Bar left side 103 may be configured to fit through left slot 113 and into left upright interior 120. Left top range set 115 may be a device to prevent bar left side 103 from moving above a predetermined height. Similarly, left bottom range set 116 may be a device to prevent bar left side 103 from moving below a predetermined height.

Right upright 106 may have a right slot 122, a right top range set 124, and a right bottom range set 126. Right slot 122 may be a rectangular slit extending vertically along a right upright bar side 128 and may face left slot 113. Right slot 122 may extend through right upright bar side 128 to provide access to a right upright interior 130. Right upright 106 largely may be hollow and enclosed completely expect for right slot 122. Right upright interior 130 may be the hollow region that may be inside right upright 106. Bar right side 105 may be configured to fit through right slot 122 and into right upright interior 130. Right top range set 124 may be a device to prevent bar right side 105 from moving above a predetermined height. Similarly, right bottom range set 126 may be a device to prevent bar right side 105 from moving below a predetermined height.

Left slot 113 and right slot 122 each may have a width large enough to permit bar 102 to move free within left slot 113 and right slot 122. Left top range set 115 may cooperate with right top range set 124 to prevent bar 102 from moving above a predetermined height while maintaining bar 102 in a horizontal position relative to floor 10. Left bottom range set 116 may cooperate with right bottom range set 126 to prevent bar 102 from moving below a predetermined height while maintaining bar 102 in a horizontal position relative to floor 10. In one example, left top range set 115, right top range set 124, left bottom range set 116, and right bottom range set 126 may be moved automatically by the push of a button connected to a motor that may be connected to each set. In another example, left top range set 115, right top range set 124, left bottom range set 116, and right bottom range set 126 each may be spring loaded pins that may be moved from one hole to the next along left upright 104 and right upright 106, respectively, to adjust a bar movement range 132 (FIG. 4) of bar 102.

Right slot 122 may have a right slot length 134. Left slot 113 may have a slot length substantially the same length as right slot length 134. Right top range set 124 and right bottom range set 126 may be moved apart from each other within right slot 122 so that right top range set 124 may be at an upper most position within right slot 122 and right bottom range set 126 approximately may be right slot length 134 from right top range set 124.

Left foot 108 and right foot 110 (FIG. 1 and FIG. 2) each may be part of a stand 136, where stand 136 may a lowest support of machine 100 positioned between floor 10 and left upright 104 and right upright 106. Left foot 108 and right foot 110 each may have perimeters that substantially may be greater than a perimeter of left upright 104 and right upright 106, respectively.

Figure 6:
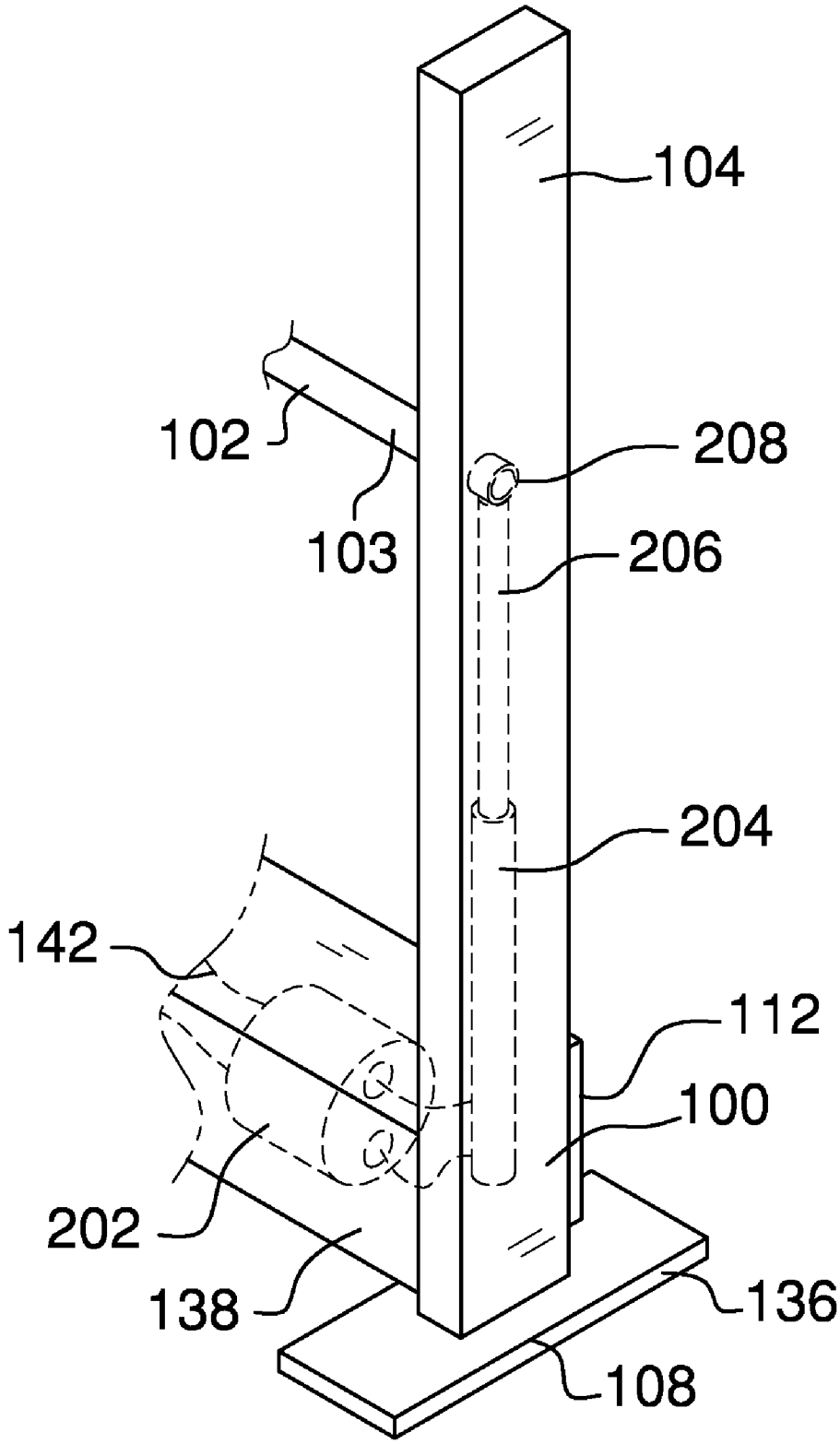
FIG. 6 is a partial isometric left side view of machine 100 with hidden parts shown by dashed lines.

Motor housing 112 may be a protective cover configured to contain and support motor 202 (FIG. 6). Motor housing 112 may have a rectangular shape and may have a motor housing front 138 and a motor housing rear 140 (FIG. 2), each of which substantially may be perpendicular to left slot 113 and right slot 122. Extending from motor housing rear 140 may be a power cord 142. Power cord 142 may be a cable that may temporarily connect motor 202 to an electrical power source.

Figure 4:
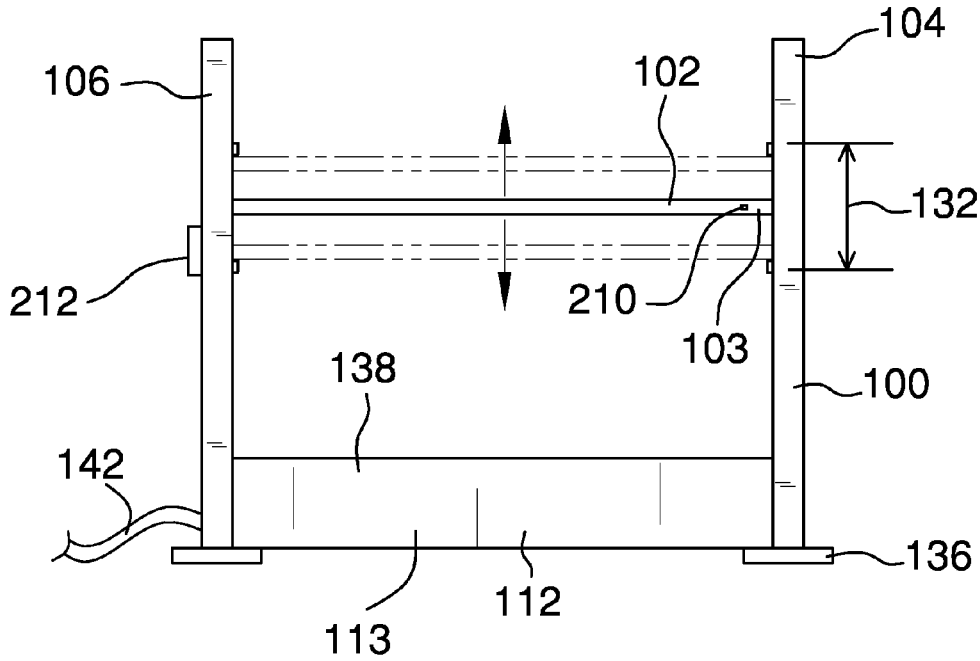
FIG. 4 is a front view of machine 100.
Figure 5:
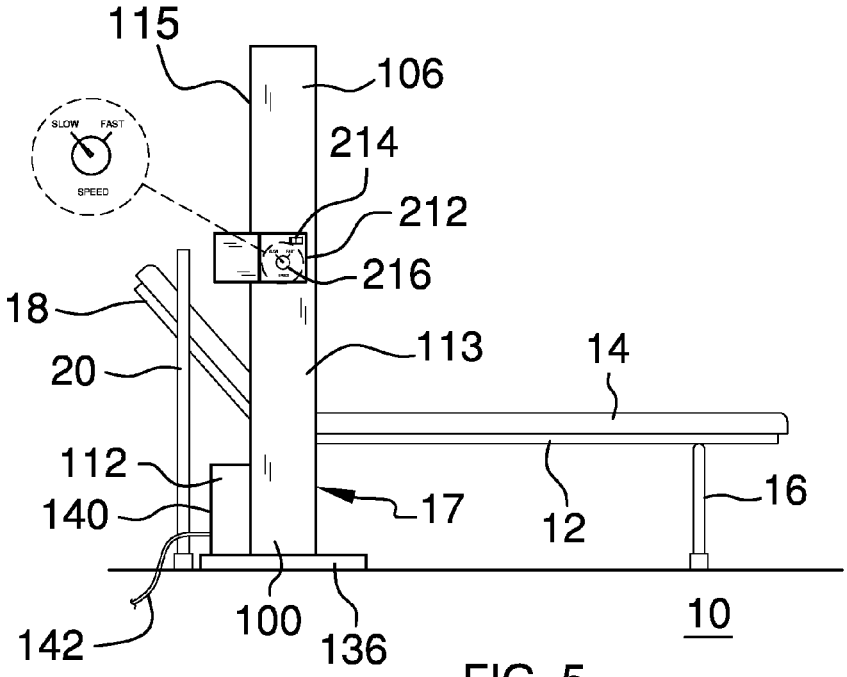
FIG. 5 is a right side view of machine 100 with a bench 12 added.

FIG. 4 is a front view of machine 100. FIG. 5 is a right side view of machine 100 with a bench 12 added. Bench 12 may be a long resting surface that may permit a person to lie down. Bench 12 may include a seat 14 connected to a bench foot stand 16, a bench back stand 17 (hidden), and an incline 18, where incline 18 may be connected to an incline stand 20.

FIG. 6 is a partial isometric left side view of machine 100 with hidden parts shown by dashed lines. In addition to motor 202, machine 100 may include cylinders 204 (FIG. 6), rods, 206, and bushings 208, and may include an activate switch 210 (FIG. 4) and control box 212 (FIG. 5). Bushing 208 may connect to an end of bar 102 (bar left end 103 and bar right end 105). Rod 206 may connect to bushing 208 and cylinder 204 may connect between rod 206 and motor 202. Motor 202 may be connected to power cord 142. Each of left upright interior 120 and right upright interior 130 may include a bushing 208, rod 206, and cylinder 204 set. Activate switch 210 may be attached to bar 102 near bar left end 103 and control box 212 may be attached to right upright 106.

Motor 202 may be a device that may convert electrical power into a mechanical force. In one example, motor 202 may be a device that may convert electrical force into mechanical power by producing electrical flow. In another example, motor 202 may be a device that may convert electrical force into hydraulic fluid power by producing hydraulic flow.

Cylinders 204 may be mechanical actuators that may convert power from motor 202 into a linear force and movement for rods 206. For example, cylinders 204 may be in hydraulic communication with rods 206 and may pass hydraulic communication signals to rods 206 in a form of linear force and movement for rods 206. Rods 206 may be pistons that may move up and down in a linear stroke in response to linear force from cylinder 204. The linear force from cylinders 204 may be fluid pressure. Bushing 208 may be a suspension bearing that may permit bar 102 to rotate within bushing 208 while preventing bar 102 from moving vertically relative to bushing 208.

Activate switch 210 (FIG. 4) may be a device to make or break a connection in a circuit connected to motor 202. Activate switch 210 may be connected to motor 202 through wires passing from activation switch 210 to motor 202. By moving activate switch 210, motor 202 may be started and stopped.

Control box 212 (FIG. 5) may be a container that may house controls to operate machine 100. Control box 212 may include a power switch 214 and control knob 216. Power switch 214 may be connected to motor 202. Control knob 216 may be connected motor 202.

Power switch 214 may be a device to make or break a connection in a circuit connected to motor 202. When power switch 214 is in an off position, activate switch 210 may be in operable. When power switch 214 is in an on position, activate switch 210 may control the flow of power to motor 202. Control knob 216 may be a round shape object that a person may grab with their fingers and rotate. Rotating control knob 216 may preset the speed at which motor 202 may raise and lower bar 102. Control knob 216 may be rotated between a slow speed and a fast speed. Control box 212 may include two control knobs 216 to independently control the up speed and the down speed of bar 102.

Hydraulic cylinders 204 and rods 206 may prevent a person pushing against bar 102 from moving bar 102 while moving bar 102 up and down based on power from motor 202. In this way, machine 100 provides a fixed resistance force whose distance from a person may vary over time. Machine 100 does not use of gravity to oppose muscle contraction nor does machine 100 use variable elastic/hydraulic resistance force to oppose muscle contraction. Thus, machine 100 may provide a safer and more convenient alternative to typical gym systems and free weights.

Figure 7:
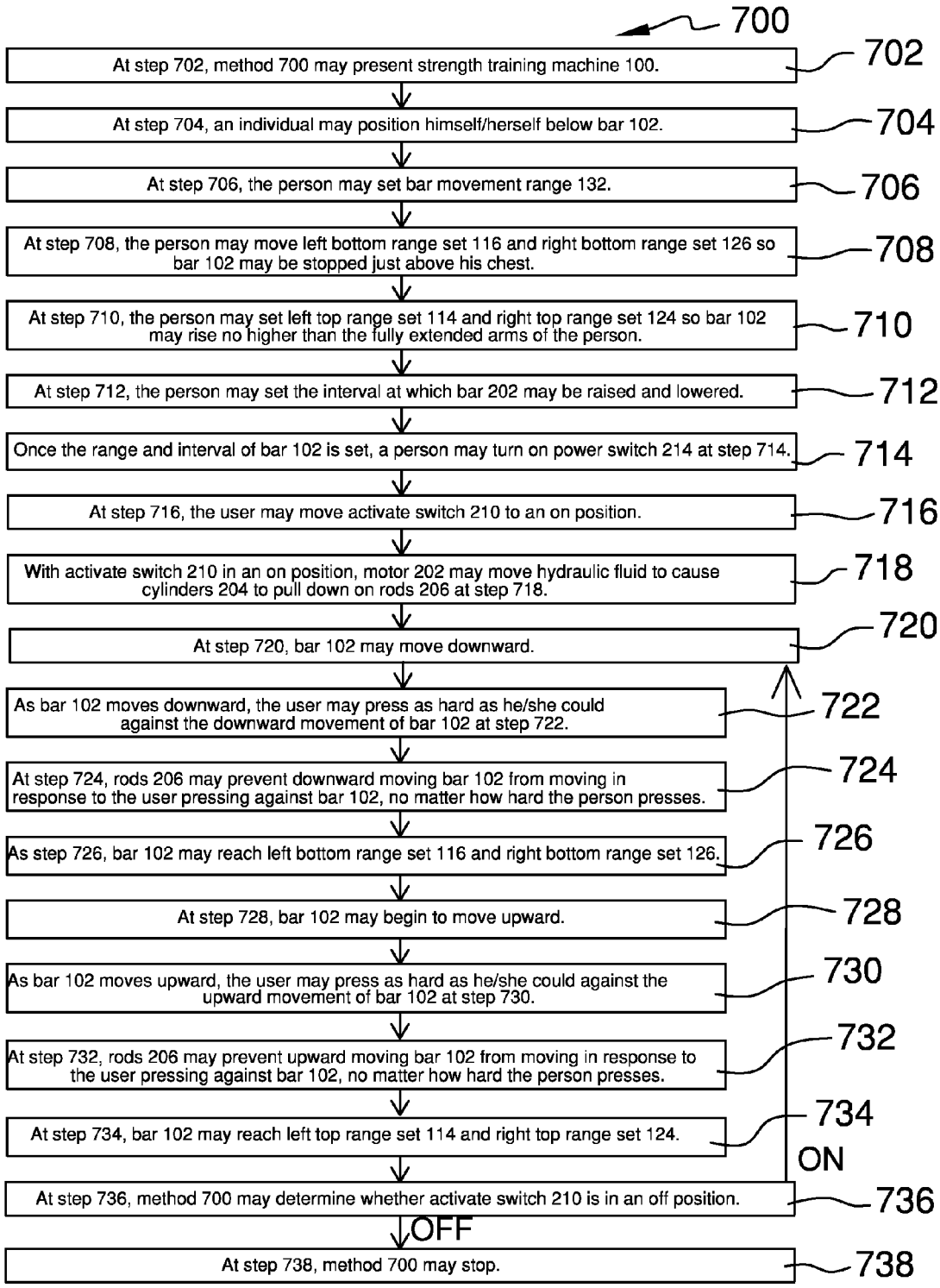
FIG. 7 is a method 700 to use strength training machine 100 for bar press and pull exercises.

FIG. 7 is a method 700 machine 100 to assist a person in strength training that person's body, such as by bar press exercises and by bar pull exercises. At step 702, method 700 may present strength training machine 100. At step 704, an individual may position himself/herself below bar 102. For example, the person may lie flat on bench 12 (FIG. 5). Alternatively, the individual may position themselves above bar 102 or to a side of bar 102. At step 706, the person may set bar movement range 132. For example, the person may engage the unit's control panel to set the weight bar's range of motions.

At step 708, the person may move left bottom range set 116 and right bottom range set 126 so bar 102 may be stopped just above the chest of the person. At step 710, the person may set left top range set 115 and right top range set 124 so bar 102 may rise no higher than the fully extended arms of the person.

At step 712, the person may set the interval at which bar 202 may be raised and lowered. In one example, the user may set bar 102 to raise the length 134 of bar movement range 132 in two seconds and lower the length 134 of bar movement range 132 in three seconds (e.g. 2 seconds up, 3 seconds down). As noted above, control box 212 may include two control knobs 216 to independently control the up speed and the down speed of bar 102. Once the range and interval of bar 102 is set, a person may turn on power switch 214 at step 714. At step 716, the user may move activate switch 210 to an on position.

With activate switch 210 in an on position, motor 202 may move hydraulic fluid to cause cylinders 204 to pull down on rods 206 at step 718. At step 720, bar 102 may move downward. As bar 102 moves downward, the user may press as hard as he/she could against the downward movement of bar 102 at step 722. Alternatively, the person may pull as hard as he/she could along with the downward movement of bar 102. At step 724, rods 206 may prevent downward moving bar 102 from moving in response to the user pressing against bar 102, no matter how hard the person presses. Motor 202, a left cylinder 204, a left rod 206, a right cylinder, and a right rod may be configured to prevent bar 102 from moving in response to the person pressing or pulling against bar 102, no matter how hard the person presses or pulls on bar 102. For example, motor 202 may use incompressible hydraulic fluid to raise and lower bar 102. Thus, a person pulling or pushing on bar 102 may be prevented from moving bar 102 due to the hydraulic fluid being incompressible.

As step 726, bar 102 may reach left bottom range set 116 and right bottom range set 126. At step 728, bar 102 may begin to move upward. This may be in response to bar 102 touching left bottom range set 116 and right bottom range set 126. For example, bar 102, left bottom range set 116, and right bottom range set 126 may have sensors that send a signal to motor 202 on coming into contact with each other. In response to this signal, motor 202 may reverse directions and move bar 102 in an opposite direction. Left top range set 115 and right top range set 124 may have sensors that end a signal to motor 202 on contacting sensors in bar 102, where the signal may cause motor 202 to reverse directions and move bar 102 in an opposite direction.

As bar 102 moves upward, the user may press as hard as he/she could against the upward movement of bar 102 at step 730. Alternatively, the person may pull as hard as he/she could against the upward movement of bar 102. At step 732, rods 206 may prevent upward moving bar 102 from moving in response to the user pressing against bar 102, no matter how hard the person presses. At step 734, bar 102 may reach left top range set 115 and right top range set 124. At step 736, method 700 may determine whether activate switch 210 is in an off position. If activate switch 210 is in an off position, method 700 may proceed to step 738. If activate switch 210 is not in an off position, then method 700 may return to step 720. At step 738, method 700 may stop.

The machine may be a type of exercise machine for a person, such as fitness enthusiasts. A person may be a human being regarded as an individual. The machine may focuses on the development of the body of that person, such as the pectoralis major muscle as well as other supporting muscles. The person may lay on his/her back on a bench while pushing up or pulling against a moving bar positioned directly above a chest of the person. While the machine may development the chest pectoral muscles, the machine also may help develop the anterior deltoids, serratus anterior, coracobrachialis, as well as the triceps of the person. In addition, the machine may focus on the development of the entire body, through squats, lunges, calf raises, and the like.

The machine may allow an individual to engage in an effective strength-training workout, while providing a safer and more convenient alternative to conventional gym systems and free weights. The machine may include a pair of upright supports. In one example, the upright supports may be produced from hollow steel tubing. These uprights may be positioned approximately 36 to 48 inches apart and may be secured to a relatively large base panel (base housing). The facing surfaces of the uprights may feature long slots. Contained within these slots may be a pair of range adjusters, one on the top, and one on the bottom. These adjusters may be configured to vary the range of motion of the bar, which may be secured between the two uprights.

Contained within the base of the machine may be a series of electric motors and/or hydraulic assemblies. The motors may engage with the bar and move the bar up and down within the slots. The motors and hydraulics also may provide a way to vary the speed at which the bar may be raised and lowered. The motors may be wired to a control box/panel featured on an outside of one of the machine's uprights. This may allow a user to adjust the rate of speed at which the bar may be raised and lowered. The motor and hydraulic components also may be wired to an on/off switch incorporated into the bar. This may allow an individual who may be using the machine to conveniently activate and deactivate the unit as desired.

An adjustable weight bench may be included with the machine. This may allow an individual to use the weight system with or without the bench. The machine may be produced in consumer versions for home use, as well as in commercial versions for use in commercial fitness centers, gyms, and rehabilitation centers. The machine also may be offered in sizes/versions for youths, adults, and elderly individuals.

The machine may fulfill a need for a safer and more convenient way to perform strength training exercises. Appealing features of the machine may be its ease of use, time savings, and ability to enhance safety among fitness enthuses. The machine may provide fitness enthusiasts with an alternative to free weights and gym systems. The machine may feature a bar that may be raised and lowered between two uprights via a series of motors and/or hydraulic devices. The user may push as hard as he may against the resistance of the bar, as the bar is being lowered and raised. This may create just the right weight for the fitness enthusiasts since an effectiveness of the exercises may be determined by the amount of force exerted by the individual, rather than an amount of weight used. The machine may be scaled smaller for rehabilitation.

Not only may the machine provide effective strength training, but also the machine may provide an effective cardiovascular workout. An individual may set the rate of speed at which the bar may be raised and lowered higher, and thus may require the user to move more quickly when exacting force against the bar. This may increase an individual's heart, circulatory, and respiratory rates, which may help burn calories. Using the machine as part of a consistent strength training program may help an individual lose weight, as well as increase strength and tone the muscles in the body. In turn, this may lead to improved performance in various sport and fitness activities, a more attractive appearance, and a healthier lifestyle.

The machine may provide a safer alternative to conventional free weights and home gym systems, since the bar may be raised and lowered automatically via motors or hydraulics rather than be dependent on input from the user. This may eliminate the risk of losing balance and falling posed to a weightlifter when holding a heavy barbell and may eliminate the risk of dropping the heavy weight while exercising. In turn, this may prevent injuries and may potentially prevent fatalities. Since the machine lacks weight plates, a need to add or change weight plates when exercising with the machine may be eliminated. This may save considerable amounts of time and may allow an individual to engage in a more consistent workout.

In addition, the machine may act as a spotter, as it may raise and lower its bar assembly automatically. This may eliminate a need to ask another individual to hold and stabilize a heavy barbell during such exercises, which may save time and particularly may be convenient when an individual may be alone. Since the machine may be safe and easy to use, the machine may not only be ideal for use among fitness/strength training enthusiasts, but the machine also may be used effectively by individuals who may be mildly handicapped or rehabilitating muscles in the body after injury or surgery. In this regard, the machine may find use in rehabilitation facilities, as well as in commercial and institutional gyms and fitness centers and in the home. This machine may be easy to use, performance enhancing, timesaving, safety enhancing, space saving, convenient, practical, and durable for years of effective, low-maintenance use.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A machine to assist a person in strength training, the strength training machine comprising:

a left upright having a left upright interior and a left upright slot;

a right upright having a right upright interior and a right upright slot, where the right upright is positioned remotely from the left upright so that the right upright slot faces the left upright slot;

a left rod positioned in the left upright interior;

a right rod positioned in the right upright interior;

a bar positioned between the left upright and the right upright and attached to the left rod through the left upright slot at a bar left end and attached to the right rod through the right upright slot at a bar right end, where the bar is configured to be grabbed substantially from underneath the bar by the hands of a person positioned both below the bar and between the left upright and the right upright;

a left cylinder positioned in the left upright interior and configured to be in hydraulic communication with the left rod such that the left rod raises and lowers in response to hydraulic communication signals from the left cylinder;

a right cylinder positioned in the right upright interior and configured to be in hydraulic communication with the right rod such that the right rod raises and lowers in response to hydraulic communication signals from the right cylinder; and a hydraulic motor connected both to the left cylinder and the right cylinder, where the hydraulic motor is configured to generate hydraulic communication signals to move the left rod and the right rod together at a constant rate so that the bar raises and lowers at a constant rate, where the hydraulic motor, the left cylinder, the left rod, the right cylinder, and the right rod are configured to prevent the bar from moving in response to the person one of pressing and pulling against the bar, no matter how hard the person presses or pulls on the bar such that the strength training is achieved by pitting the muscles of the person against the moving bar that is immovable by the muscles of the person.

2. The strength training machine of claim 1, further comprising:

a left top range set position in the left slot above the bar left side;

a left bottom range set positioned in the left slot below the bar left side;

a right top range set position in the right slot above the bar right side; and a right bottom range set positioned in the right slot below the bar right side, where the left top range set and the right top range set cooperate together to prevent the bar from moving above a predetermined height that is less than a uppermost limit of extension of the bar, and where the left bottom range set and the right bottom range set cooperate together to prevent the bar from moving below a predetermined height that is less than a downwardmost limit of contraction of the bar.

3. The strength training machine of claim 2, further comprising:

a left busing connecting the left rod to the bar left end; and a right busing connecting the right rod to the bar right end.

4. The strength training machine of claim 3, further comprising:

an activate switch attached to the bar and configured to be in communication with the hydraulic motor to turn on the hydraulic motor and to turn off the hydraulic motor.

5. The strength training machine of claim 4, further comprising:

a control box attached to the right upright, where the control box includes a power switch and a control knob, where the power switch and the control knob are connected to the hydraulic, where when the power switch is in an off position, the activate switch is in operable and when the power switch is in an on position, the activate switch controls the flow of power to the hydraulic motor, and where the control knob is configured to preset the speed at which hydraulic motor raises and lowers the bar.

6. The strength training machine of claim 5, where the hydraulic motor, the left cylinder, the left rod, the right cylinder, and the right rod are configured to provide a fixed resistance force in the bar whose distance from a person below the bar varies over time.

7. A machine to assist a person in strength training, the strength training machine comprising:

a left upright having a left upright interior and a left upright slot;

a right upright having a right upright interior and a right upright slot, where the right upright is positioned remotely from the left upright so that the right upright slot faces the left upright slot;

a left rod positioned in the left upright interior;

a right rod positioned in the right upright interior;

a bar positioned between the left upright and the right upright and attached to the left rod through the left upright slot at a bar left end and attached to the right rod through the right upright slot at a bar right end, where the bar is configured to be grabbed substantially from underneath the bar by the hands of a person positioned both below the bar and between the left upright and the right upright; and a means for moving the bar up and down at a constant rate, where the means for moving the bar is configured to prevent the bar from moving in response to the person one of pressing and pulling against the bar, no matter how hard the person presses or pulls on the bar such that the strength training is achieved by pitting the muscles of the person against the moving bar that is immovable by the muscles of the person.

8. The strength training machine of claim 7, where the means for moving includes a left cylinder positioned in the left upright interior and configured to be in hydraulic communication with the left rod such that the left rod raises and lowers in response to hydraulic communication signals from the left cylinder, a right cylinder positioned in the right upright interior and configured to be in hydraulic communication with the right rod such that the right rod raises and lowers in response to hydraulic communication signals from the right cylinder, and a hydraulic motor connected both to the left cylinder and the right cylinder, where the hydraulic motor is configured to generate hydraulic communication signals to move the left rod and the right rod together at a constant rate so that the bar raises and lowers at a constant rate, where the hydraulic motor, the left cylinder, the left rod, the right cylinder, and the right rod are configured to prevent the bar from moving in response to the person one of pressing and pulling against the bar, no matter how hard the person presses or pulls on the bar.

9. The strength training machine of claim 7, further comprising:

a left top range set position in the left slot above the bar left side;

a left bottom range set positioned in the left slot below the bar left side;

a right top range set position in the right slot above the bar right side; and a right bottom range set positioned in the right slot below the bar right side, where the left top range set and the right top range set cooperate together to prevent the bar from moving above a predetermined height that is less than a uppermost limit of extension of the bar, and where the left bottom range set and the right bottom range set cooperate together to prevent the bar from moving below a predetermined height that is less than a downwardmost limit of contraction of the bar.

10. The strength training machine of claim 9, further comprising:

an activate switch attached to the bar and configured to be in communication with the hydraulic motor to turn on the hydraulic motor and to turn off the hydraulic motor.

11. The strength training machine of claim 10, further comprising:

a left busing connecting the left rod to the bar left end; and a right busing connecting the right rod to the bar right end.

12. The strength training machine of claim 10, further comprising:

a control box attached to the right upright, where the control box includes a power switch and a control knob, where the power switch and the control knob are connected to the hydraulic, where when the power switch is in an off position, the activate switch is in operable and when the power switch is in an on position, the activate switch controls the flow of power to the hydraulic motor, and where the control knob is configured to preset the speed at which hydraulic motor raises and lowers the bar.

13. The strength training machine of claim 12, where the hydraulic motor, the left cylinder, the left rod, the right cylinder, and the right rod are configured to provide a fixed resistance force in the bar whose distance from a person below the bar varies over time.

14. A method to use a machine to assist a person in strength training, the method comprising:

presenting a strength training machine, where the strength training machine includes a left upright having a left upright interior and a left upright slot, a right upright having a right upright interior and a right upright slot, where the right upright is positioned remotely from the left upright so that the right upright slot faces the left upright slot, a left rod positioned in the left upright interior, a right rod positioned in the right upright interior, a bar positioned between the left upright and the right upright and attached to the left rod through the left upright slot at a bar left end and attached to the right rod through the right upright slot at a bar right end, where the bar is configured to be grabbed substantially from underneath the bar by the hands of a person positioned both below the bar and between the left upright and the right upright, a left cylinder positioned in the left upright interior and configured to be in hydraulic communication with the left rod such that the left rod raises and lowers in response to hydraulic communication signals from the left cylinder, a right cylinder positioned in the right upright interior and configured to be in hydraulic communication with the right rod such that the right rod raises and lowers in response to hydraulic communication signals from the right cylinder, and a hydraulic motor connected both to the left cylinder and the right cylinder, where the hydraulic motor is configured to generate hydraulic communication signals to move the left rod and the right rod together at a constant rate so that the bar raises and lowers at a constant rate, where the hydraulic motor, the left cylinder, the left rod, the right cylinder, and the right rod are configured to prevent the bar from moving in response to the person one of pressing and pulling against the bar, no matter how hard the person presses or pulls on the bar;

receiving the hands of the person around the bar;

setting an interval at which the bar is raised and lowered;

turning on a power switch connected to the motor;

moving an activate switch connected to the motor to an on position to cause the bar to move at a constant rate; and receiving force in the bar from the hands of the person.

15. The method of claim 14, where the strength training machine further includes a left top range set position in the left slot above the bar left side, a left bottom range set positioned in the left slot below the bar left side, a right top range set position in the right slot above the bar right side, and a right bottom range set positioned in the right slot below the bar right side, where the left top range set and the right top range set cooperate together to prevent the bar from moving above a predetermined height, and where the left bottom range set and the right bottom range set cooperate together to prevent the bar from moving below a predetermined height, the method further comprising:

setting a bar movement range by moving the left top range set, the right top range set, the left bottom range set, and the right bottom range set.

16. The method of claim 15, where the left bottom range set and the right bottom range set are moved so the bar is prevented from moving any lower than just above the chest of the person.

17. The method of claim 16, where the left top range set and the right top range set are moved so the bar is prevented from moving any higher than the fully extended arms of the person and where receiving the hands of the person around the bar is from a position that is underneath the bar.

18. The method of claim 17, further comprising:

determining whether an activate switch attached to the bar is in an off position, where if the activate switch is in an off position, the bar is stopped.

19. The method of claim 15, where the left top range set and the right top range set cooperate together to prevent the bar from moving above a predetermined height that is less than an uppermost limit of extension of the bar, and where the left bottom range set and the right bottom range set cooperate together to prevent the bar from moving below a predetermined height that is less than a downwardmost limit of contraction of the bar.

20. The method of claim 14, where the strength training is achieved by pitting the muscles of the person against the moving bar that is immovable by the muscles of the person.

* * * * *